US007832163B2

(12) United States Patent
Krzowski

(10) Patent No.: US 7,832,163 B2
(45) Date of Patent: Nov. 16, 2010

(54) SCREED RAIL

(75) Inventor: Jean-Paul Krzowski, Stone (GB)

(73) Assignee: Metal Screed (SC) Limited (SC)

( * ) Notice: Subject to any disclaimer, the term of this patent is extended or adjusted under 35 U.S.C. 154(b) by 609 days.

(21) Appl. No.: 11/578,460

(22) PCT Filed: Apr. 22, 2005

(86) PCT No.: PCT/GB2005/001554

§ 371 (c)(1),
(2), (4) Date: Oct. 16, 2006

(87) PCT Pub. No.: WO2005/103412

PCT Pub. Date: Nov. 3, 2005

(65) Prior Publication Data

US 2007/0193162 A1 Aug. 23, 2007

(30) Foreign Application Priority Data

Apr. 24, 2004 (GB) ..... 0409216.9

(51) Int. Cl.
*E01C 23/01* (2006.01)
*E01C 11/04* (2006.01)
*E04C 3/16* (2006.01)

(52) U.S. Cl. ..... 52/364; 52/369; 52/372; 404/48

(58) Field of Classification Search ..... 52/318, 52/364–367, 369, 371–374, 326, 327, 332, 52/333, 251, 252; 404/48, 49, 68; 249/3, 249/6, 14

See application file for complete search history.

(56) References Cited

U.S. PATENT DOCUMENTS

| | | | | | |
|---|---|---|---|---|---|
| 1,202,269 | A | * | 10/1916 | Cramer | 249/8 |
| 1,974,950 | A | | 9/1934 | Cornell, Jr. | |
| 2,611,169 | A | * | 9/1952 | Torrelli | 249/4 |
| 2,663,925 | A | | 12/1953 | Yates | |
| 2,772,468 | A | * | 12/1956 | Heltzel | 249/3 |
| 4,202,145 | A | * | 5/1980 | Coulter et al. | 52/169.1 |
| 4,339,106 | A | * | 7/1982 | Navarro | 249/219.1 |
| 4,506,481 | A | * | 3/1985 | Witschi et al. | 52/127.2 |
| 4,846,437 | A | | 7/1989 | Fitzgerald et al. | |
| 5,076,536 | A | * | 12/1991 | Fitzgerald | 249/219.1 |
| 5,096,155 | A | * | 3/1992 | Fitzgerald | 249/219.1 |
| 5,154,536 | A | * | 10/1992 | Ciudaj | 404/118 |
| 5,205,942 | A | * | 4/1993 | Fitzgerald | 249/3 |

(Continued)

FOREIGN PATENT DOCUMENTS

| | | | |
|---|---|---|---|
| EP | 0093697 | | 9/1983 |
| GB | 2421049 | A * | 6/2006 |

OTHER PUBLICATIONS

International Search Report Jul. 26, 2005.

*Primary Examiner*—Brian E Glessner
*Assistant Examiner*—Jason Holloway
(74) *Attorney, Agent, or Firm*—Ira S. Dorman

(57) ABSTRACT

A boundary screed rail assembly with screed rails (14) supported by feet members (42). The screed rails (14) providing a perimeter part (24) with upper and lower protection parts (26). The upper part (26) provides a planar horizontal surface (28), with a plurality of recesses (30) extending thereinto, alternating with downwardly extending engagement members (32) engageable in the concrete of a slab.

22 Claims, 4 Drawing Sheets

U.S. PATENT DOCUMENTS 5,363,619 A * 11/1994 McPhee ..... 52/367
5,766,645 A 6/1998 Kaminski
5,956,912 A * 9/1999 Carter et al. ..... 52/396.02
6,074,129 A * 6/2000 Nowak et al. ..... 404/96
6,705,582 B2 * 3/2004 Osborn ..... 249/6
6,751,919 B2 * 6/2004 Calixto ..... 52/573.1
6,874,288 B1 * 4/2005 Washa et al. ..... 52/371
7,051,988 B2 * 5/2006 Shaw et al. ..... 249/219.1
7,204,471 B2 * 4/2007 Pietrobon ..... 249/139
7,290,749 B1 * 11/2007 Jessop et al. ..... 249/34
7,546,719 B1 * 6/2009 Guevara ..... 52/716.2

* cited by examiner

SCREED RAIL

This invention concerns improvements in or relating to boundary screed rails.

Boundary screed rails are used to define the perimeter of a volume in which a slab or other structure of a settable material is formed. Such slabs may typically be of concrete and form the floor of large structures such as for example warehouses, and will be cast in situ. The screed rails also provide the surface level of the slab, as well as providing edge protection therefor.

Where screed rails are provided on adjacent concrete floor slabs, it is important that the screed rails are at the same height, and protect the adjacent edges of the slabs to prevent breaking of or chipping thereof. The joint between the slabs must also be such as to permit contraction and expansion of the slabs, and also permit vertical loads to be received on the joints without damage to the slabs.

According to the present invention there is provided a boundary screed rail assembly, the assembly incorporating a screed rail which includes a generally planar perimeter part, and a plurality of feet members engageable with the ground to support the perimeter part on one side in a generally vertical alignment, the screed rail also includes a protection part extending along the in use upper edge of the perimeter part, the protection part including a planar upper surface extending in use generally horizontally from the perimeter member towards said one side, a plurality of spaced recesses extending into the edge of the planar surface away from the perimeter part, and a plurality of spaced engagement members extending in use generally downwardly from the said edge of the planar surface.

The engagement members and recesses are preferably alternately spaced along said edge of the planar surface, so as to define gaps between the engagement members, which gaps extend into the planar surface.

The engagement members may widen away from said edge. The sides of the engagement members may be rounded. The sides of the recesses may be rounded. The sides of the engagement members and recesses may lie substantially on a common circumference.

A protection part may also be provided along the in use lower edge of the perimeter part.

The perimeter and protection parts may be integrally formed.

The screed rail may be formed in discrete lengths which can be joined together as required. Adjacent lengths of screed rail may be mountable together by a respective feet member.

Mounting portions may be provided on the perimeter part to permit mounting of the feet members thereto. The mounting portions may be recessed towards said one side of the perimeter part such that fastening means for mounting the feet members to the perimeter part substantially do not extend beyond the other side of the perimeter part. Mounting formations may be provided in the mounting portions, which formations may be in the form of in use vertically extending slots.

The feet members may include a mounting part engageable with the mounting portions on the perimeter member, and a plurality of mounting holes may be provided on the mounting parts. The feet members may include a web part extending from the mounting part to a ground engaging part. The web part is preferably generally triangular, and a mounting hole may be provided therein. One or more mounting holes may be provided in the ground engaging part.

A plurality of openings may be provided in the perimeter part, and the openings may be configured to permit any of circular or square section, or plate dowels to extend therethrough.

An embodiment of the present invention will now be described by way of example only and with reference to the accompanying drawing, in which.

Figure 9:
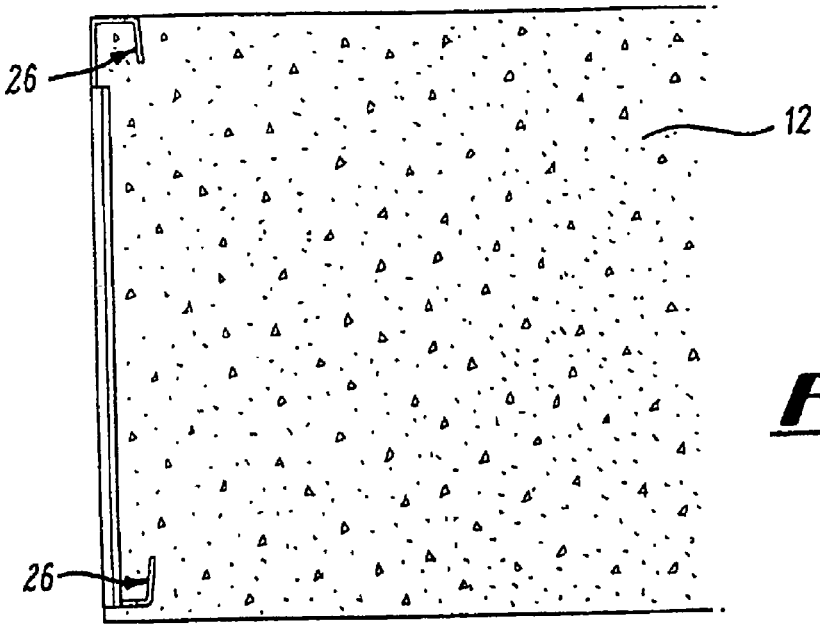
FIG. 9 is a diagrammatic sectional view of the assembly of FIG. 1 in use in a concrete slab.
Figure 10:
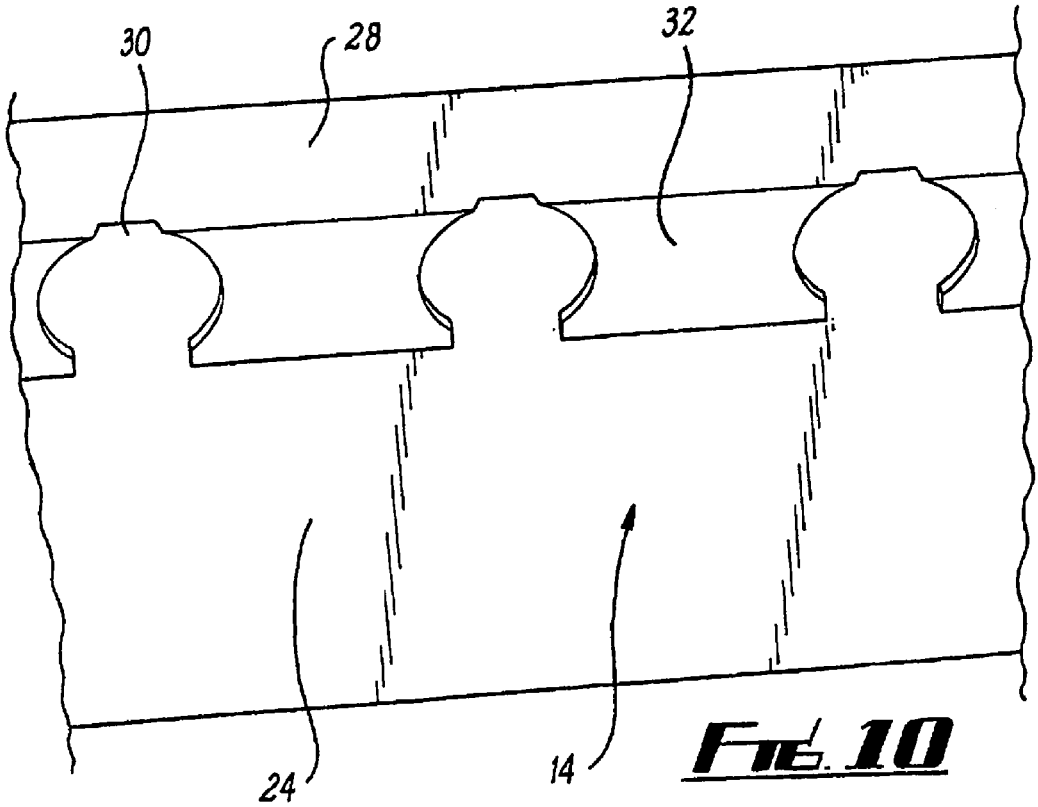
FIG. 10 is an enlarged perspective view of a portion of the assembly of FIG. 1.

The drawings show a boundary screed rail assembly 10 suitable for use in forming concrete slabs 12 as shown in FIG. 9. The assembly 10 comprises a screed rail 14, and a plurality of feet members 16 mounted to the screed rail 14 at a number of locations by fasteners in the form of bolts 18 with heads 20, and corresponding wing nuts 22.

The rail 14 is elongate and can be provided in lengths and joined together and cut as required. The rail comprises a substantially planar perimeter part 24 alignable substantially vertically in use. Identical protection parts 26 are provided at the top and bottom of the perimeter part 24.

The protection parts 26 provide a planar horizontal surface 28. A plurality of spaced recesses 30 extend a short distance into the surface 28 on the opposite side thereof from the perimeter part 24. Between each of the recesses 30 a downwardly extending engagement member 32 is provided. Each engagement member 32 widens away from the horizontal surface 28, with arcuate side walls.

A plurality of openings 34 are provided along the length of the perimeter part 24. The openings 34 are of a generally squat and wide T shape. The openings 34 permit circular or square section, or plate dowels to extend therethrough. Above each of the openings 34 a small circular opening 35 is provided. This permits adjacent rails 14, as for instance shown in FIG. 7, to be held together for instance by plastics material fastenings, prior to pouring of the concrete.

A plurality of mounting portions 36 are provided along the screed rails 14. The mounting portions 36 include a recess towards the side of the rails 14 on which the protection parts 26 are provided. Two lower and two upper vertical slots 38 are provided in the portions 36. Similar mounting portions 40 are provided at the ends of the rails 14, except that the end portions 40 only include one upper and one lower slot 38.

The assembly 10 also comprises a plurality of feet members 42. The feet members 42 include a mounting plate 44 engageable against the rear of the recessed mounting portions 36, with four mounting holes 46 alignable with the respective slots 38. A generally triangular web 48 extends perpendicularly from the mounting plate 40 to a footplate 50. A mounting hole 52 is provided in the web 48, as well as three larger holes 53 which provide a weight saving and help to anchor the members 42 in the concrete. Two small and two large holes 54, 56 are provided in the footplates 50.

Figure 1:
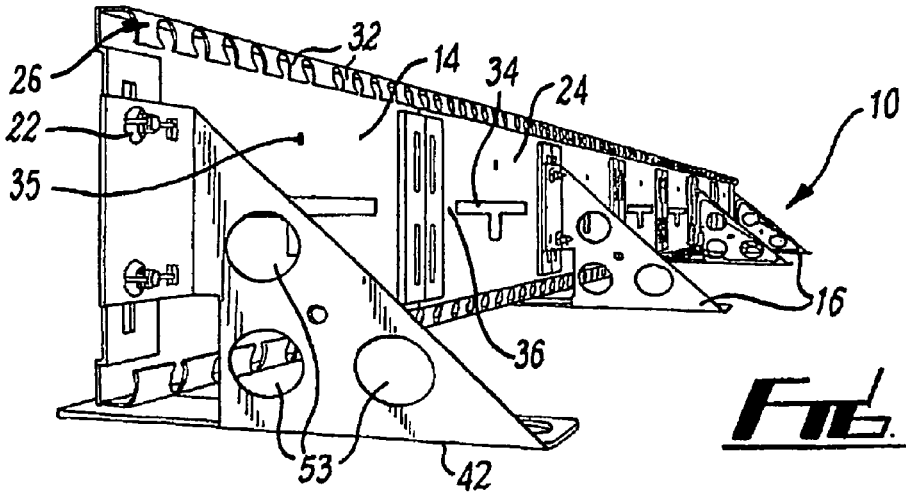
FIG. 1 is a diagrammatic perspective view of a boundary screed rail assembly according to the invention.
Figure 2:
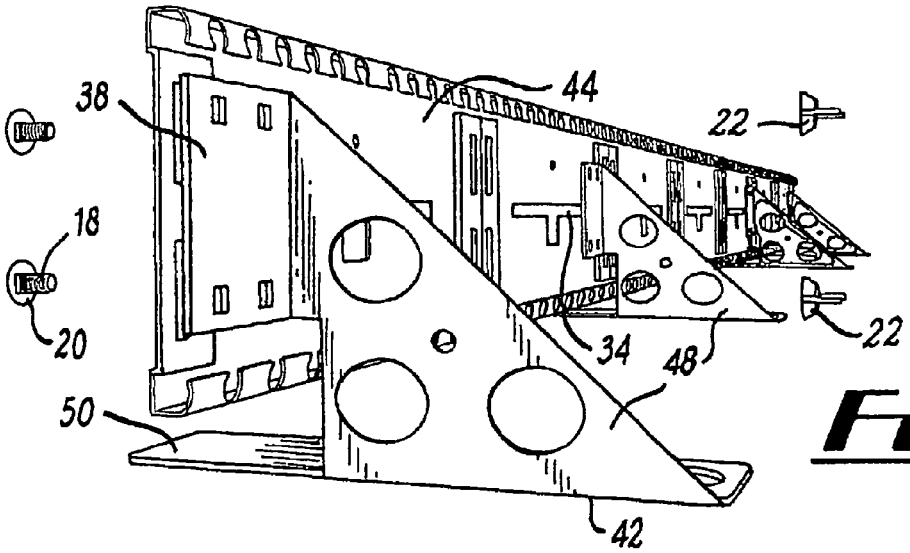
FIG. 2 is a similar view to FIG. 1 but in a partially disassembled state.
Figure 3:
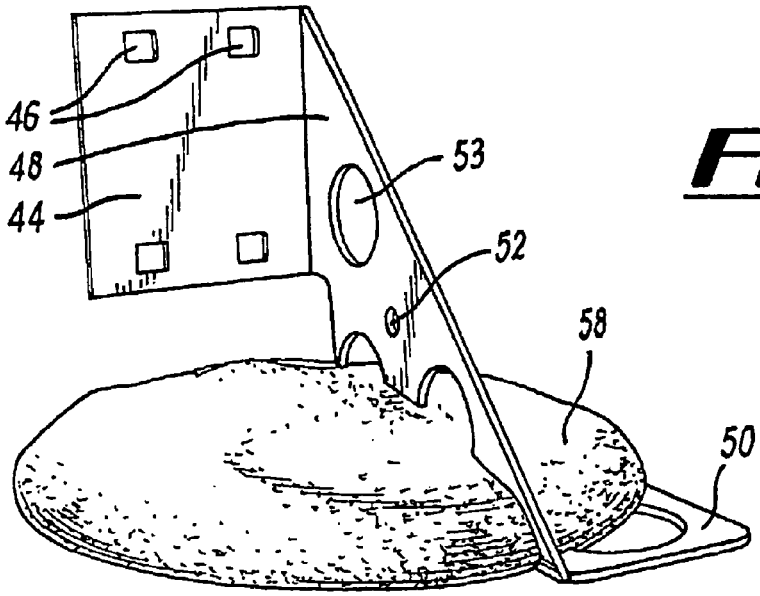
FIG. 3 is a diagrammatic perspective view of part of the assembly of FIG. 1 illustrating a method of mounting said part to the ground.

In use, the feet members 16 are mounted in a required position. The members 16 may for instance be mounted on hardcore by spikes extending through one or more of the holes 54, 56. Where such an arrangement is not possible, the feet members 16 may be mounted by a portion of concrete 58 as shown in FIG. 3, which concrete 58 will extend through at least some of the holes 53, 54, 56.

Figure 4:
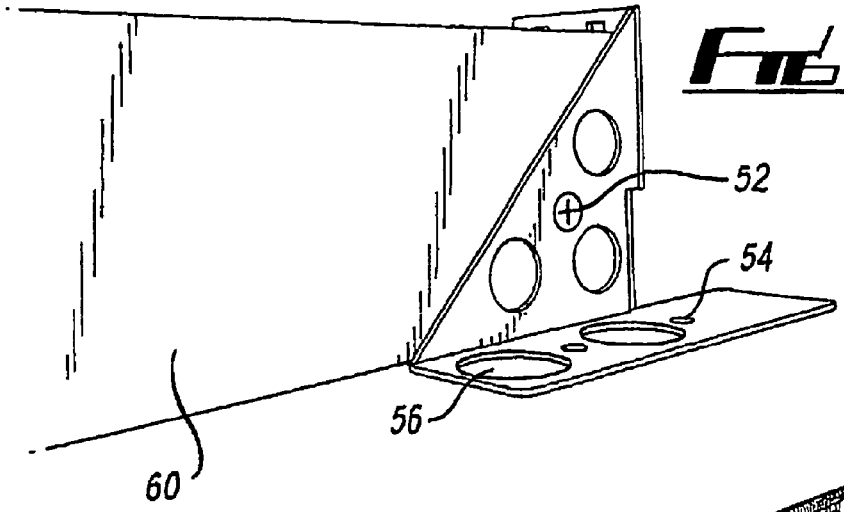
FIG. 4 is a perspective view showing an alternative way of mounting the part of FIG. 3 to the ground.
Figure 5:
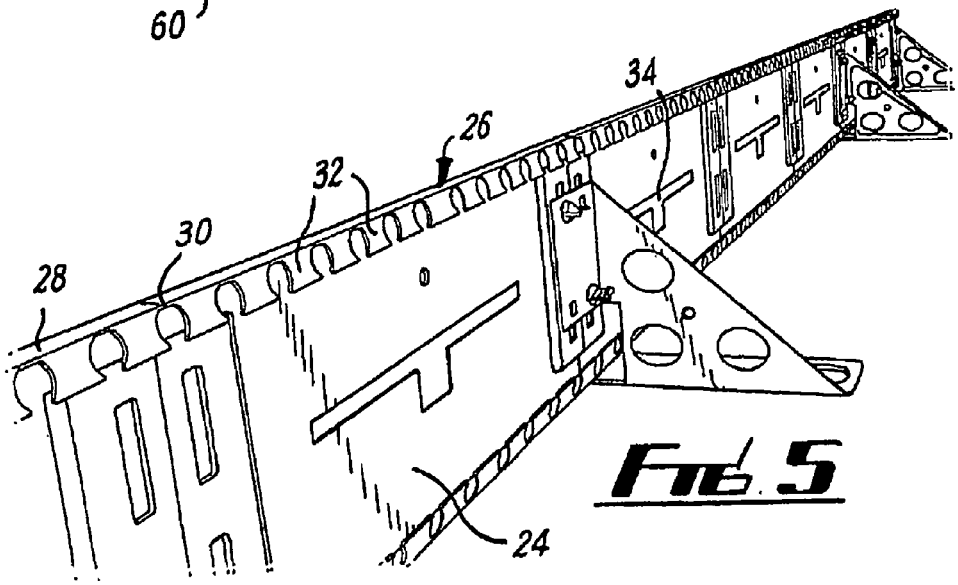
FIG. 5 is a further perspective view of the assembly of FIG. 1.
Figure 6:
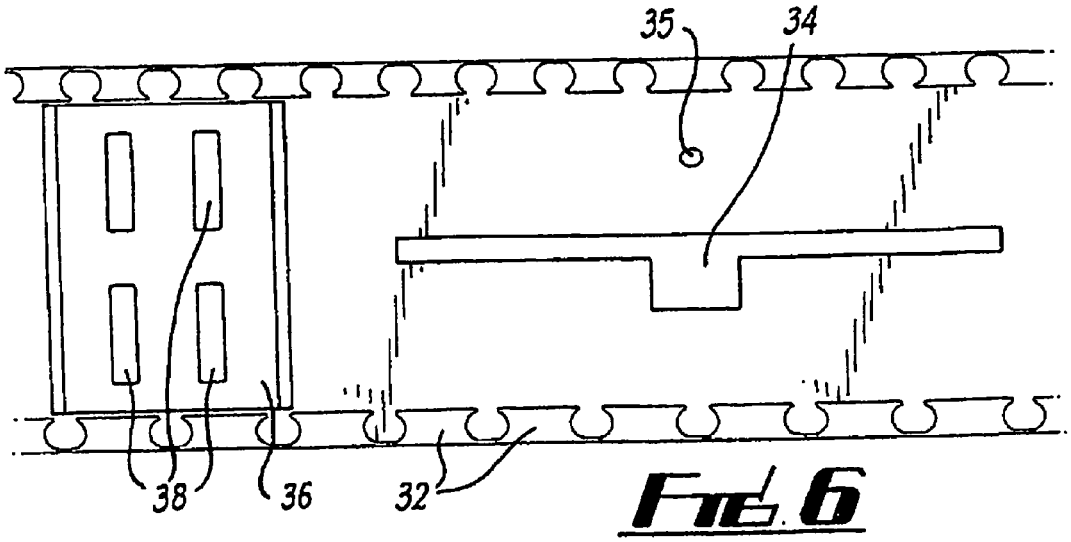
FIG. 6 is a side view of part of the assembly of FIG. 1.

Alternatively, the feet members 16 may be mounted to pieces of wood 60 (FIG. 4) by a nail passing through the hole 52, with the wood 60 being mounted in position elsewhere as possible. The screed rail or rails 14 are then mounted to respective feet members using the wing nuts 22 and bolts 18, with the nuts 22 on the same side of the screed rails 14 as the feet members 16. The height of the screed rails 14 can be set as required by virtue of the slots 38.

Figure 7:
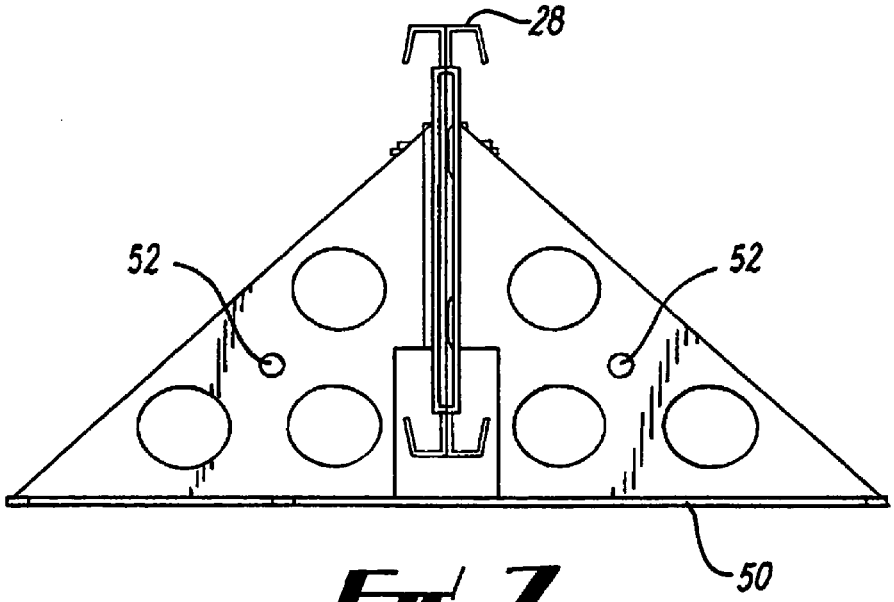
FIG. 7 is a diagrammatic cross sectional view of two of the assemblies of FIG. 1 located adjacent each other.
Figure 8:
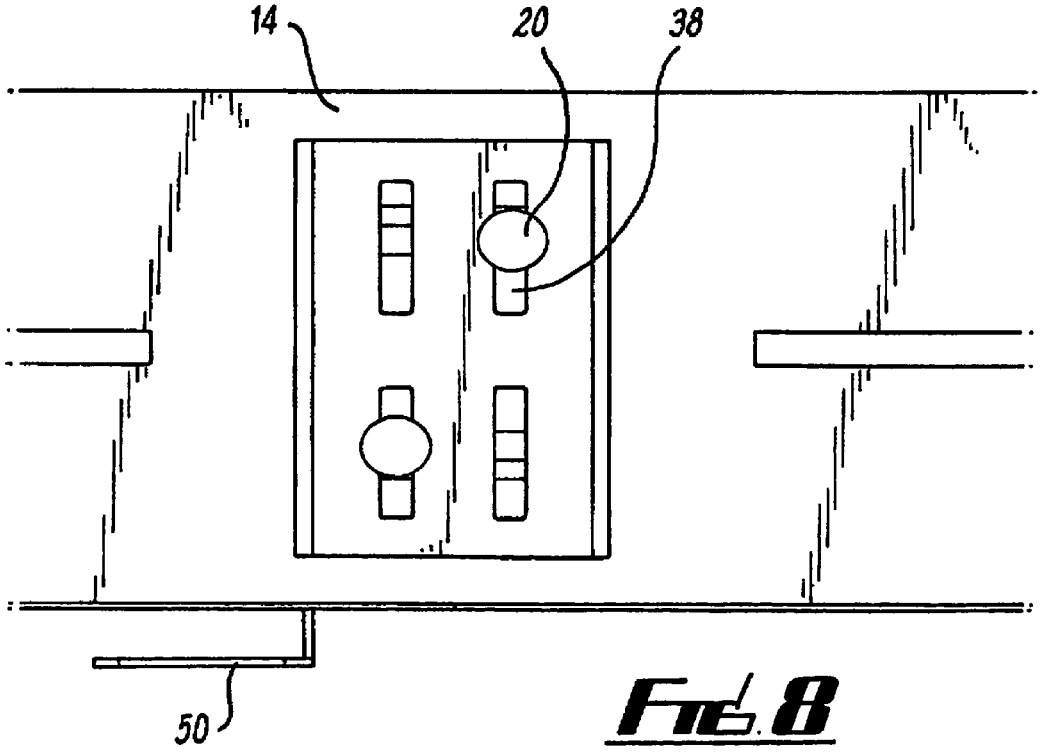
FIG. 8 is a side view of a further part of the assembly of FIG. 1.

The bolt heads 20 are accepted in the mounting portion recesses 36. FIG. 7 illustrates the positioning of two screed rails 14 to produce a joint between two slabs which will be adjacent each other. In view of the recessing of the bolt heads 20, the two screed rails 14 can be located immediately adjacent each other. Appropriate dowels as required can be inserted through the openings 34. FIG. 8 illustrates how two screed rails 14 can be joined lengthways to each other by a single foot member 16, which is mainly hidden behind the rails 14, and is mounted to respective end mounting portions 40 on the rails.

Once the assembly or assemblies 10 are fully assembled, concrete can be poured into the space defined thereby to provide an arrangement as shown in FIG. 9. A levelling mechanism or straight edge can be run along the horizontal surfaces 28 to level the concrete 12. The engagement members 32 provide for a good engagement between the screed rails 14 and the concrete 12 whilst not providing for a single linear joint which can readily lead to cracking. The widening of the engagement members 32 away from the horizontal surface provides a good anchorage thereof in the concrete 12. The feature of the recesses 30 extending into the horizontal surfaces 28, permits any potentially trapped air to be evacuated from within the protection parts 26.

The assembly shown therefore permits strong edge protection to be provided, whilst reducing the possibility of damage occurring to the edge of the concrete. The assemblies permit ready adjustment of the height of the screed rails, and also adjacent assemblies to be located close to each other. The screed rails can readily be connected lengthwise to each other to provide a boundary of a required length. Different types of doweling can be provided to absorb vertical loads between adjacent slabs, and also to substantially prevent relative vertical movement between adjacent slabs.

Various modifications may be made without departing from the scope of the invention. For instance, in the illustrated assembly the screed rail is formed as an integral component by bending. Separate components could however be used in the screed rail. The shape of the recesses and/or engagement members could be different, and the recesses could be formed on the same circumference as the sides of the engagement members. Alternatively the engagement members may have a different shape, but which preferably also widens away from the horizontal surface.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A concrete slab assembly including a concrete slab having a boundary screed rail anchored thereto, the screed rail comprising:
   - a generally planar perimeter part providing a generally vertical perimeter for the concrete slab;
   - a plurality of feet members secured to one side of the perimeter part and engaged with a ground surface beneath the concrete slab, the feet members being embedded in the concrete slab; and
   - a protection part secured to an upper edge of the perimeter part, the protection part including:
     - a planar upper member extending generally horizontally from the perimeter part on said one side of the perimeter part level with a majority of an upper surface of the concrete slab,
     - a plurality of spaced engagement members extending downwardly into the concrete slab from an edge of the planar upper member spaced from the perimeter part, and
     - recesses corresponding to spaces formed between adjacent engagement members and extending a short distance into an edge of the planar upper member spaced from the perimeter part for evacuation of any trapped air within the protection part.

2. An assembly according to claim 1 in which the engagement members and recesses are alternately spaced along said edge of the said planar upper member.

3. An assembly according to claim 1, in which the engagement members widen away from said edge.

4. An assembly according to claim 1, in which the sides of the engagement members are rounded.

5. An assembly according to claim 4, in which the sides of the recesses are rounded.

6. An assembly according to claim 5, in which the sides of the engagement members and recesses lie substantially on a common circumference.

7. An assembly according to claim 1, in which a protection part is also provided along a lower edge of the perimeter part.

8. An assembly according to claim 7, in which the perimeter and protection parts are integrally formed.

9. An assembly according to claim 1, in which the screed rail is formed in discrete lengths which can be joined together as required.

10. An assembly according to claim 9, in which adjacent lengths of screed rail are mountable together by a respective foot member.

11. An assembly according to claim 1, in which mounting portions are provided on the perimeter part to permit mounting of the feet members thereto.

12. An assembly according to claim 11, in which the mounting portions are recessed towards said one side of the perimeter part such that fastening means for mounting the feet members to the perimeter part substantially do not extend beyond the other side of the perimeter part.

13. An assembly according to claim 11, in which mounting formations are provided in the mounting portions.

14. An assembly according to claim 13, in which the mounting formations are in the form of in use vertically extending slots.

15. An assembly according to claim 11, in which the feet members include a mounting part engageable with the mounting portions on the perimeter member.

16. An assembly according to claim 15, in which a plurality of mounting holes are provided on the mounting parts.

17. An assembly according to claim 15, in which the feet members include a web part extending from the mounting part to a ground engaging part.

18. An assembly according to claim 17, in which the web part is generally triangular.

19. An assembly according to claim 17, in which a mounting hole is provided in the web part.

20. An assembly according to claim 17, in which at least one mounting hole is provided in the ground engaging part.

21. An assembly according to claim 1, in which a plurality of openings are provided in the perimeter part.

22. An assembly according to claim 21, in which the openings are configured to permit dowels selected from dowels of circular and square section, and plate dowels to extend therethrough.

* * * * *